310-335
6/11/85 XR 4,523,293 SR

United States Patent [19]

Auld et al.

[11] Patent Number: 4,523,293

[45] Date of Patent: Jun. 11, 1985

[54] TWO-DIMENSIONAL BULK ACOUSTIC WAVE CORRELATOR-CONVOLVER

[75] Inventors: Bert A. Auld, Menlo Park; Donald W. Pettibone, Cupertino; James D. Plummer, Mountain View, all of Calif.

[73] Assignee: The United States of America as represented by the Secretary of the Air Force, Washington, D.C.

[21] Appl. No.: 482,377

[22] Filed: Apr. 5, 1983

[51] Int. Cl.[3] ..... G06G 7/00; G06C 7/195

[52] U.S. Cl. ..... 364/821; 364/819; 364/822; 358/213; 310/335

[58] Field of Search ..... 364/800, 807, 819, 821–822; 382/42; 310/322, 324–335; 358/213

[56] References Cited

U.S. PATENT DOCUMENTS

| | | | |
|---|---|---|---|
| 3,400,341 | 9/1968 | Sittig | 310/335 X |
| 3,519,331 | 7/1970 | Cutrona et al. | 364/822 X |
| 3,634,749 | 1/1972 | Montgomery | 364/822 X |
| 3,641,355 | 2/1972 | Preston, Jr. | 364/822 X |
| 3,676,590 | 7/1972 | Weimer | 178/7.1 |
| 3,745,353 | 7/1973 | Jernigan et al. | 250/216 |
| 3,769,615 | 10/1973 | de Klerk | 310/334 X |
| 3,970,778 | 7/1976 | Adkins | 178/7.1 |
| 4,017,751 | 4/1977 | Desormiere et al. | 310/334 X |
| 4,041,536 | 8/1977 | Melcher et al. | 358/213 |
| 4,225,887 | 9/1980 | Gautier | 358/213 |
| 4,225,938 | 9/1980 | Turpin | 364/822 |

OTHER PUBLICATIONS

"Processing of Optical Images with Optically Controlled Acoustic Transducers", by B. A. Auld and D. W. Pettibone, 1978 Ultrasonics Symposium Proceedings, IEEE Cat. #87CH 1344-ISU, pp. 243–249.

"An Electronically Addressed Bulk Acoustic Wave Fourier Transform Device", by B. A. Auld, D. W. Pettibone, J. D. Plummer and R. G. Swartz, 1979 Ultrasonic Symposium Proceedings, IEEE Cat. #79CH 1482, pp. 184–188.

*Primary Examiner*—Jerry Smith
*Assistant Examiner*—Gary V. Harkcom
*Attorney, Agent, or Firm*—Donald J. Singer; Richard J. Donahue

[57] ABSTRACT

A two-dimensional bulk acoustic wave correlator-convolver having an acoustic mirror positioned two focal lengths from an integrated circuit-acoustic transducer array. The image, rather than the Fourier transform, of the input spatial distribution is returned to the transducer array by the mirror.

10 Claims, 4 Drawing Figures

TWO-DIMENSIONAL BULK ACOUSTIC WAVE CORRELATOR-CONVOLVER

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to apparatus for performing coherent processing with acoustical waves. More particularly it concerns a novel two-dimensional bulk acoustic wave correlator-convolver that does not require the performance of two Fourier transforms.

It has long been recognized that coherent Fourier processing of picture information and other two-dimensional data displays offers substantial advantages in processing speed because of its inherently parallel, rather than serial, nature. However, the principal disadvantage of most coherent optical Fourier processing systems has been the lack of both adequate interface devices at the input and output of the systems and spatial frequency filters in the interior of the systems.

There has been previously disclosed a coherent acoustic Fourier processing device using bulk acoustic waves that has distinct advantages over its optical counterpart. For a detailed description of this device, see B. A. Auld and D. W. Pettibone, "Processing of Optical Images with Optically Controlled Acoustic Transducers", 1978 Ultrasonics Symposium Proceedings, IEEE Cat. #78CH 1344-ISU, pages 243–249. The use of bulk acoustic waves rather than optics in coherent Fourier processing systems has the advantage that the phase of the distribution at the Fourier transform plane is directly measurable and can be read out serially with an acoustic imaging transducer, thereby facilitating real time phase and amplitude filtering. Like its optical counterpart, such a system requires a high quality spatial modulator at the input.

The aforementioned 1978 IEEE paper describes in great detail a spatial acoustic modulator capable of introducing a desired two-dimensional modulation on a coherent acoustic beam at the input of the system to establish a two-dimensional phase and amplitude modulation of the beam at the Fourier transform plane. To permit use of the system with a serially scanned input and an indirect optical input, such as the electrical input from a TV camera tube, a spatial acoustic modulator is proposed which includes an integrated circuit fabricated with electrodes defining individual transducer elements or cells. High impedance field effect transistors are used to amplify the signals appearing across the transducer elements with additional field effect transistors serving to gate the signals so that the array can be multiplexed.

The work described in the aforementioned 1978 IEEE paper has been extended and is discussed in a subsequent paper by B. A. Auld, D. W. Pettibone, J. D. Plummer and R. G. Swartz entitled "An Electronically Addressed Bulk Acoustic Wave Fourier Transform Device", 1979 Ultrasonic Symposium Proceedings, IEEE Cat. #79CH 1482, pages 184–188. A novel spatial IC-acoustic transducer array was built and tested having the capability of accepting serial electrical data and, through the use of sample and hold units formed on an associated integrated circuit, using the data to spatially modulate a coherent acoustic bulk wave. The Fourier transform of the scanned image appears in the back focal plane of the acoustic lens of the spatial IC-acoustic transducer. The expression "IC" is frequently used herein in place of the term "integrated circuit". Once the Fourier transform of the scanned image is obtained, matched filtering can be derived by a multiplication in the Fourier domain, followed by another Fourier transform.

SUMMARY OF THE INVENTION

The present invention concerns a further extension of the data processing concepts and apparatus described above.

For a most important application of these concepts, i.e., performance of two-dimensional correlations and convolutions, it has heretofore been necessary to have two complete devices, one to perform a Fourier transform before multiplication by the reference pattern and another to transform back to the image plane. The two-dimensional correlator-convolver of the present invention uses only one spatial IC-acoustic transducer array which includes a matrix of piezoelectric transducer cells formed at one end of a metallic rod. The other end of the metallic rod has a convex surface which forms an acoustic mirror for reflecting acoustic waves within the metallic rod. The length of the metallic rod is twice the focal length of the acoustic mirror whereby the image, rather than the Fourier transform, of the input spatial distribution is returned to the transducer cells by the acoustic mirror.

DESCRIPTION OF THE PREFERRED EMBODIMENT

Figure 1:
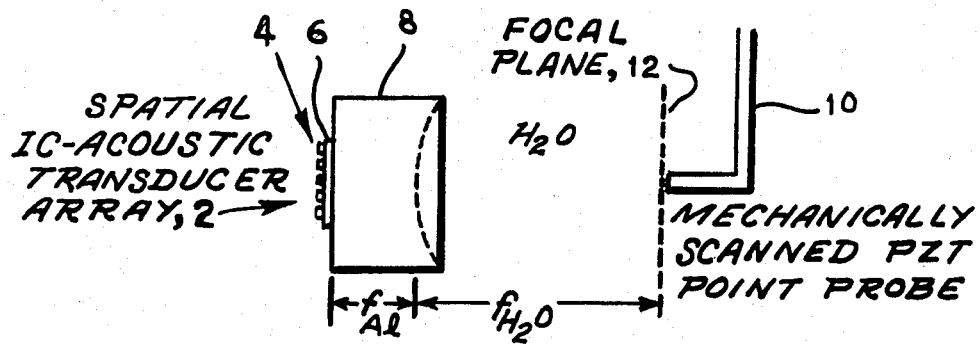
FIG. 1 PRIOR ART
FIG. 1 is a schematic of the prior art spatial IC-acoustic transducer array disclosed in the aforementioned 1979 IEEE publication.

Referring now to FIG. 1, a spatial IC-acoustic transducer array 2 is formed by evaporating gold electrodes 4 of an integrated circuit on the back surface of a thin piezoelectric disc 6 formed of PZT (lead-zirconium-titanate) material. The electrodes are 250 microns wide and are spaced 400 microns apart, center to center. The PZT disc 6 is a half wavelength, 75 micron, substrate indium bonded to an aluminum lens 8. The focal length of lens 8 in water is 7.6 centimeters and in the aluminum is 1.8 centimeters. The individual transducer elements formed by the electrodes are wire bonded to integrated circuit sample and hold circuitry. A mechanically scanned PZT point probe 10 is positioned at the focal plane 12 of the array 2 to obtain the Fourier transform of the electrical signals applied to the array 2.

Figure 2:
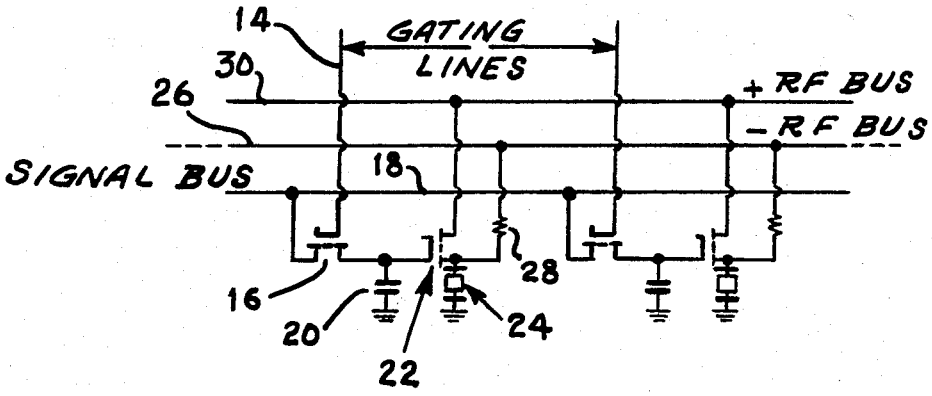
FIG. 2 PRIOR ART
FIG. 2 is a schematic of a segment of the addressing circuitry for the prior art transducer array of FIG. 1, also disclosed in the aforementioned 1979 IEEE publication.

FIG. 2 is an electrical schematic of a two cell segment of the integrated circuit used with the prior art transducer array of FIG. 1. When a particular gating line, such as the line 14 for example is held high, gating FET (field effect transistor) 16 of that cell is enabled, thus storing the voltage present on the signal bus 18 on the storage capacitor 20. This voltage now appears on the gate of field effect transistor 22 and modulates the resistance of that FET. The RF voltage impressed on the transducer element 24 is therefore a function of the voltage on storage capacitor 20. The expression "RF" is frequently used herein in place of the term "radio frequency". A minus RF bus 26 supplies another voltage through a resistor 28 to transducer element 24. This voltage is advanced 180 degrees with respect to the voltage on the plus RF bus 30, thereby giving the device a bipolar capability and increasing its flexibility. The RF frequency is preferrably 30 $MH_z$. The aforementioned circuitry is formed on an integrated circuit chip, which is a part of the transducer array described in more detail in the aformentioned 1979 IEEE paper.

Figure 3:
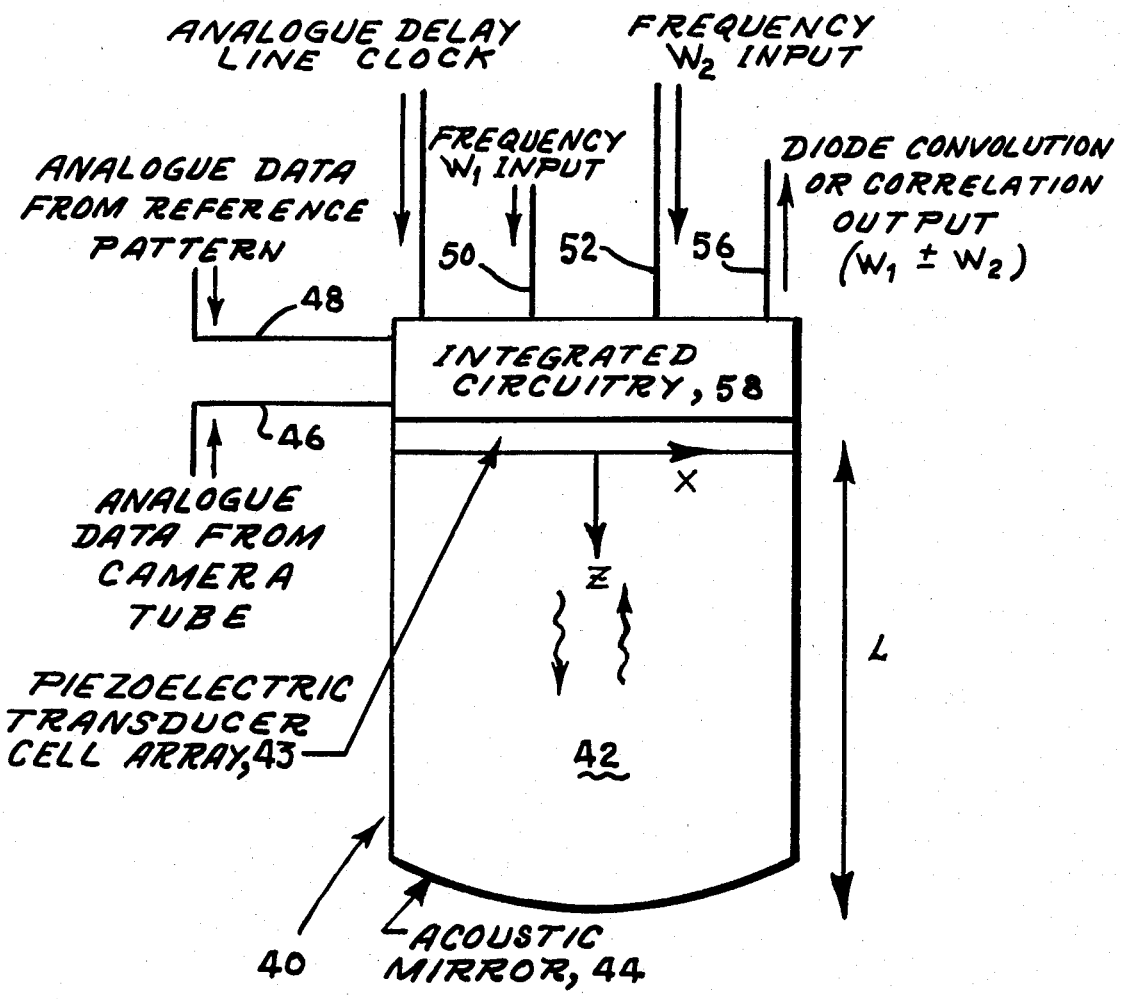
Figure 3 is a general schematic of the two-dimensional bulk acoustic wave correlator-convolver of the present invention.

The two-dimensional correlator-convolver device of the present invention, depicted in FIG. 3, comprises a spatial IC-acoustic transducer array 40 wherein the lens 8 of FIG. 1 has been replaced by a cylindrical aluminum rod 42 having a convex end surface forming a reflective acoustic mirror 44. Mirror 44 is spaced at a distance L of two focal lengths from the piezoelectric transducer cells 43 such that the image, rather than the Fourier transform, of the input spatial distribution is returned to the matrix of transducer cells 43 by the acoustic mirror 44.

As is seen from FIG. 3, analogue data is fed into the device from a vidicon via lead 46 and from a reference store via lead 48. Here, however, the analog camera signal on lead 46 modulates an RF signal of frequency $W_1$ applied via lead 50, and the reference data on lead 48 modulates an RF signal of frequency $W_2$ applied via lead 52. A linear superposition of these signals is launched simultaneously into the acoustic medium comprising aluminum rod 42 transducer and then returned to the cell 43 delayed, but unchanged because of the imaging property of the mirror 44.

Upon their return to the matrix of transducer cells 43 the modulated RF signals $W_1$ and $W_2$ are mixed in a diode at each cell of the array and the mixed products are summed over all cells of the two-dimensional array by combining in a summing bus for each line and then adding the outputs of all the individual summing busses. This process, described in detail below, is something like a two-dimensional analog of the one-dimensional SAW diode correlator, where a convolution or correlation is obtained by a suitable choice of the reference function, and the convolution or correlation function is scanned as a function of time by propagation of the input and reference surface IC-acoustic waves relative to each other.

In order to provide the scanning feature which is required to scan out the convolution or correlation function on lead 56, a set of shift registers may be incorporated into the IC circuitry 58 of FIG. 3, one for each row of the array, these serving to shift the camera signal along one spatial dimension in order to read out the variation of the convolution or correlation function in terms of one spatial dimension. For certain potential applications, such as character recognition, this is sufficient. If a full two-dimensional scan of the function is required, the process can be repeated with the camera and reference signals rotated 90 degrees with respect to the rows of the array. The effective processing speed of such a device is sufficiently high to permit this.

Figure 4:
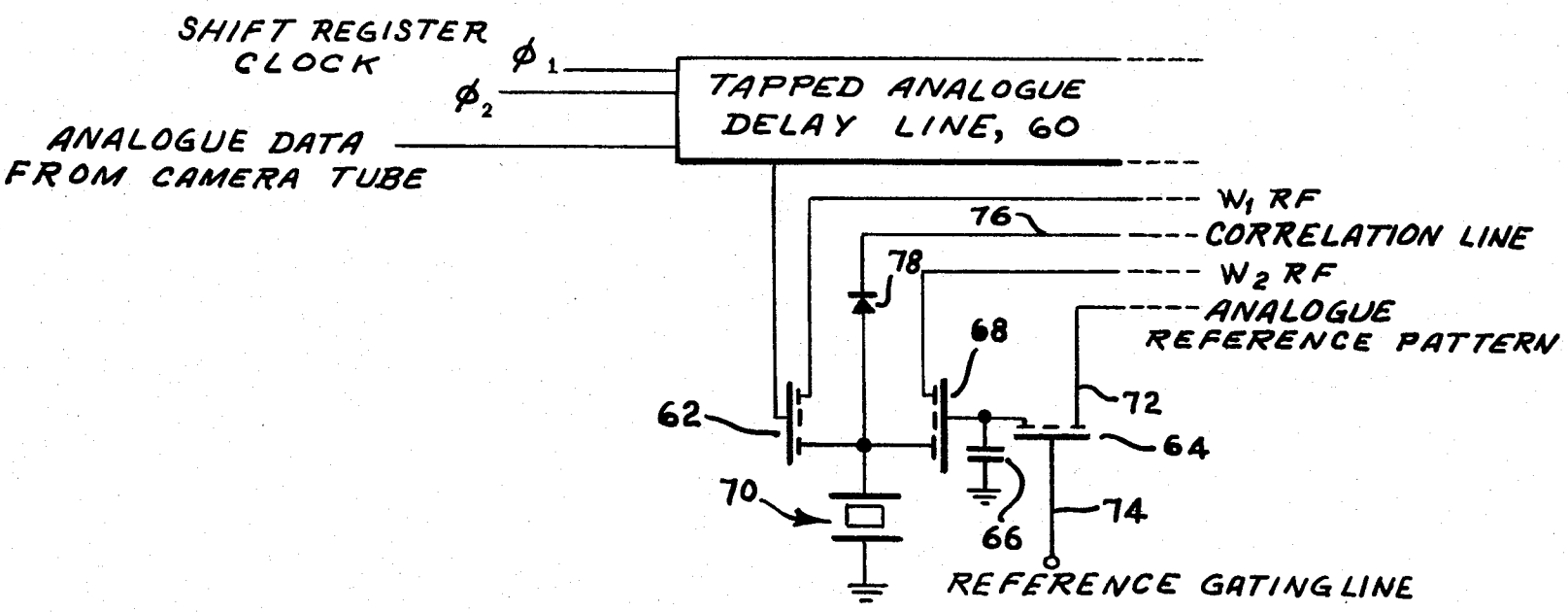
Figure 4 is an electrical schematic of a segment of the transducer array addressing circuitry of the present invention.

FIG. 4 illustrates the form of the addressing circuitry for a single cell of the IC-transducer array shown in FIG. 3. A comparison with the prior art addressing circuitry FIG. 2 shows certain common elements, but the gating FET 16 and storage capacitor 20 in FIG. 2 are now replaced in FIG. 4 by a tapped delay line 60. Tapped delay line (shift register) 60 serves to address and shift the analog camera signal along one line of the transducer array. Furthermore, the balance resistor 28 is replaced by a gating FET 64, a storage capacitor 66 and an RF switching FET 68 for simultaneously applying the reference signal to the transducer element or cell 70 via lead 72. This reference signal is addressed to the transducer array by one of a series of gating lines 74, and is held there while the camera signal information is shifted through the analogue delay line 60 in a time Tw. A similar sequence occurs for each line of the array so that a fixed two-dimensional reference wave at $W_2$ and a continuously varying two-dimensional camera signal wave at $W_1$ are simultaneously launched into the IC-acoustic transducer array 40. After the launching time Tw the RF voltages can be cut off and the analogue delay line 60 cleared, while the acoustic waves propagate down to the mirror 44 and back. During this period the diode correlation line 76, which is reverse biased to prevent loading of and cross-talk between the transducers during the input cycle of length Tw, is biased to the appropriate point for mixing the returned acoustic signals in the diode 78. These signals arrive atter a round-trip delay time $T_d$ down to the mirror 44 and back. At this moment the fixed reference signal and the scanned camera signal are mixed and summed in the diodes 78, giving a one-dimensional scan of the two-dimensional convolution or correlation function. After read-out during a period Tw of the mixed signal, the diodes 78 of each cell are back biased again and a new cycle of camera signals applied to the device. This may be 90°-rotated picture and reference information, as described above, or it may be the next frame of the picture sequence.

In the sequence described above, the only function of the bulk acoustic wave delay is to act as a temporary store, allowing the write-in and read-out operations of the IC circuitry to be separated in time. This serves to prevent cross-talk through the diodes, which can be reverse biased during the write-in operation, and it also avoids problems with spurious coupling of the different frequencies ($W_1$, $W_2$, $W_1 \pm W_2$) through parasitic capacitances. A much more important use of the acoustic delay is that it allows a modification of the system in FIG. 4 that although it increases the processing time by 33%, permits a very substantial simplification of the IC circuitry and improves its operation characteristics.

The purpose of the balance resistor line of FIG. 2 is to raise the dynamic range of the device to a satisfactory level. Without it the performance is of this prior art device unacceptable. Now the circuit of FIG. 4 would become excessively complicated if balance lines and resistors were added for frequencies $W_1$ and $W_2$. Suppose that the $W_2$ addressing circuitry on the right-hand side of FIG. 4 were replaced by a minus $W_1$ line and a balance resistor. With this modification, the array launches a continuously varied two-dimensions signal wave at $W_1$ into the device of FIG. 3 during the writing time $T_w$. While this wave is returning to the transducer during the acoustic delay period, the rf is cut off and the analog delay line is cleared while simultaneously reading into it the analog reference signal. Then when the front end of the spatially and temporally modulated camera signal arrives back at the transducer array, frequency $W_2$ is applied to the plus and minus rf busses and the diodes are biased to the appropriate value for mixing. After the convolution or correlation function has been read out, the analogue delay line is cleared of the analogue reference data while simultaneously reading in the next cycle of analogue camera data.

In evaluating the time required for one cycle of this processing, it will be noted that the time required for clearing and loading the analog delay line is the same as the time $T_W$ required to shift each line of camera signal information along the corresponding line of transducers in the array. The minimum round-trip delay time in the bulk IC-acoustic transducer array 40 of FIG. 3 will then be $(T_d)_{min}=2T_W$. For this value of delay, the IC-acoustic transducer array is completely filled with camera data, from the piezoelectric transducer cells 43 to the acoustic mirror 44, at the end of the write-in period $T_W$. Another period of $T_w$ is required to clear the analogue delay line of camera data and refill it with reference data. At this point the front end of the camera signal wave has arrived back at the array and the read-out cycle can begin. This again takes a period $T_W$, the duration of the camera signal wave. After this period the analogue delay line 60 can be cleared of reference data and reloaded with camera data preparatory to the start of another cycle. The total processing cycle therefore requires a total time $4T_W$, determined by the speed of the analogue delay line. For the more complicated circuitry of FIG. 4, where the analogue delay line is used only to shift the analogue camera data and the bulk IC-acoustic transducer array is used only to separate temporally the write-in and read-out operations, the total processing cycle requires only $3T_W$.

The analogue delay line 60 to be used for this type of processor can be a bucket brigade or a CCD (charge coupled diode) device, which are now available at sampling rates up to 5 to 10 MHz. At the present time commercially available bucket brigade delay lines with 32 taps can operate up to about 4 MHz. For the CCD's, devices which sample at a 10 MHz rate are readily available. In the latter case $T_w$ is 3 microseconds and the processing time for one full cycle as described above, is either 9 microseconds for the circuit version shown in FIG. 4 or 12 microseconds for the simpler circuit described herein. This means that a 32×32 or 1024 element image corresponding to the use of a 32-tap analogue delay line can have a one-dimensional scan of the two-dimensional correlation read-out in 12 microseconds, corresponding to an effective processing bandwidth of 85 MHz. This effective bandwidth increases with the number of elements in the analogue delay line and becomes 250 MHz for a 100 tap CCD delay line or 500 MHz for a 200 tap CCD delay line. For the simplified version of the circuitry, a unit cell of dimensions of the order of 100 micrometers × 100 micrometers will give a device dimension in the range of 2.5 centimeters ×2.5 centimeters, with an IC-acoustic frequency of about 90 MHz.

It can be seen therefore from the above parameters that the invention described herein when used in conjunction with a CCD camera tube provides the potential for performing two-dimensional image correlations at very fast rates.

Although the invention has been described with reference to a particular embodiment, it will be understood to those skilled in the art that the invention is capable of a variety of alternative embodiments within the spirit and scope of the appended claims.

What is claimed is:

1. A two-dimensional bulk acoustic wave correlator-convolver comprising:

a cylindrical rod having a first and a second end surface, said first end surface being planar and perpendicular to the longitudinal axis of said rod, a piezoelectric disc having one side thereof affixed to the external portion of said first end surface of said rod, and an integrated circuit multiplexing means attached to the other side of said piezoelectric disc, said integrated circuit multiplexing means including electrodes defining a matrix of addressable transducer cells in said piezoelectric disc, said second end surface of said rod being convex to form an acoustic mirror for reflecting acoustic waves originating at said piezoelectric disc and propagated through said rod, said rod having a length equivalent to twice the focal length of said acoustic mirror.

2. A two-dimensional bulk acoustic wave correlator-convolver as claimed in claim 1 wherein said rod is formed of aluminum.

3. A two-dimensional bulk acoustic wave correlator-convolver as claimed in claim 2 wherein said piezoelectric disc is formed of lead-zirconium-titanate material.

4. A two-dimensional bulk acoustic wave correlator-convolver as claimed in claim 1 wherein said integrated circuit multiplexing means further includes for each transducer cell of said matrix of cells:

first amplifier means for modulating a first RF signal with analogue scanned vidicon data and for coupling said first RF signal to said transducer cell, second amplifier means for modulating a second RF signal with analogue reference pattern data and for coupling said second RF signal to said transducer cell, and signal mixing means coupled to said transducer cell for providing the product of said first and second RF signals received by said transducer cell after reflection by said acoustic mirror.

5. A two-dimensional bulk acoustic wave correlator-convolver as claimed in claim 4 wherein said first and said second amplifier means each comprises a field effect transistor device.

6. A two-dimensional bulk acoustic wave correlator-convolver as claimed in claim 5 wherein said signal mixing means comprises a diode.

7. A two-dimensional bulk acoustic wave correlator-convolver as claimed in claim 6 and further comprising:

a tapped analogue delay line having an input and a plurality of outputs each coupled to one of said first amplifier means in a row of said matrix of transducer cells, and means for coupling analogue scanned vidicon data to the input of said analog delay line.

8. A two-dimensional bulk acoustic wave correlator-convolver as claimed in claim 7 wherein said tapped analogue delay line comprises a charge coupled diode delay line.

9. A two-dimensional bulk acoustic wave correlator-convolver as claimed in claim 7 wherein said tapped analogue delay line comprises a bucket brigade delay line.

10. A two-dimensional bulk acoustic wave correlator-convolver as claimed in claim 7 and further comprising:

gating means coupled to each of said second amplifier means for coupling analogue reference pattern data to selected ones of said second amplifier means.

* * * * *